US006010136A

United States Patent [19]

Hoskin

[11] Patent Number: 6,010,136

[45] Date of Patent: Jan. 4, 2000

[54] BRAKING SYSTEM AND METHOD

[76] Inventor: Robert F. Hoskin, 3851 Angora Pl., Duluth, Ga. 30136

[21] Appl. No.: 08/620,675

[22] Filed: Mar. 26, 1996

[51] Int. Cl.[7] ..... A63C 17/14

[52] U.S. Cl. ..... 280/11.2; 280/11.27

[58] Field of Search ..... 280/11.2, 11.22, 280/11.19, 11.23, 11.27, 11.25, 11.21; 188/413, 29, 25, 264 R

[56] References Cited

U.S. PATENT DOCUMENTS

| | | | |
|---|---|---|---|
| 5,207,438 | 5/1993 | Landers | 280/11.2 |
| 5,374,071 | 12/1994 | Johnson | 280/11.2 |
| 5,390,941 | 2/1995 | Pozzobon et al. | 280/11.19 |
| 5,411,276 | 5/1995 | Moldenhauer | 280/11.2 |
| 5,413,362 | 5/1995 | De Santis | 280/11.2 |
| 5,511,805 | 4/1996 | MacGrath | 280/11.2 |
| 5,575,489 | 11/1996 | Oyen et al. | 280/11.22 |
| 5,630,596 | 5/1997 | Rudolph | 280/11.2 |
| 5,630,597 | 5/1997 | Klukos | 280/11.2 |
| 5,639,104 | 6/1997 | Haldemann | 280/11.2 |
| 5,755,449 | 5/1998 | Pozzobon | 280/11.2 |
| 5,868,404 | 2/1999 | Montague | 280/11.2 |

*Primary Examiner*—Lanna Mai
*Assistant Examiner*—Bridget Avery
*Attorney, Agent, or Firm*—Jones and Askew, LLP

[57] ABSTRACT

Apparatus and method for applying braking forces to two spaced apart rotating members such as in-line roller skate wheels. Also apparatus and method of cooling a rotating member using a porous media through which a heat transfer fluid is forced.

23 Claims, 9 Drawing Sheets

SC
RS
SCC 80
14
10
120
16
130
SS
14
76
SF
131
ASW
AMA
124
ASW
AMA
ASW
ASW
ARS
SW
SWP
SF
SW
SWP
sSW
dSW
dSW
dSW

RS
SC
SS
SCC
14
80
125
10
120
16
SF
126
14
76
ARS
ASW
122
AMA
SW
SF
SWP
SW
SWP 55
11
15
342
121
20
340
420
316
310
314
380
376
400
395
378
65
41
346
54
312
R5
5F
5W
5WP
AMA
AMA
5WP
5W

BRAKING SYSTEM AND METHOD

BACKGROUND OF THE INVENTION

This invention relates generally to braking and cooling systems and more particularly to high heat transfer braking systems capable of simultaneously applying braking forces to multiple rolling members and cooling systems for rapidly cooling rotating members.

It is frequently desirable to cool rotating members that are being heated such as those found in braking systems. Various heat conducting fin designs have been used in the past for cooling of rotating members. Additional cooling has been achieved by directing a stream of heat transfer fluid over the heated surfaces of the rotating members. Various techniques have been applied to non-rotating heated members such as those disclosed in the following patents:

| U.S. Pat. No. | Issue Date | Inventor | Class/Subclass |
|---|---|---|---|
| 5,147,020 | 9/1992 | Scherman et al. | 361/386 |
| 5,312,693 | 5/1994 | Paul | 428/554 |

None of these prior art techniques have been able to provide a high rate of heat transfer for rotating members in order to be able to minimize the exposed heat transfer surface on the rotating member. This has been particularly true for in-line roller skates.

In-line roller skates such as that disclosed in U.S. Pat. No. 5,028,058 to B. J. Olson have become increasingly popular for fitness, recreational, and competitive skating. The in-line roller skates enable skaters to achieve high skating speeds, particularly when skating outdoors on hilly terrain. A number of prior art braking devices have become available in an attempt to provide brakes which develop substantial braking forces that are required for safe operation under such conditions. Examples of various prior art brakes are illustrated in the following patents:

| U.S. Pat. No. | Issue Date | Inventor | Class/Subclass |
|---|---|---|---|
| 1,402,010 | 1/1922 | Ormiston | 280/11.2 |
| 1,956,433 | 4/1934 | Young | 188/77 |
| 3,224,785 | 12/1965 | Stevenson | 280/11.2 |
| 3,811,542 | 5/1974 | Hamrick et al. | 188/259 |
| 3,828,895 | 8/1974 | Boaz | 188/77R |
| 4,033,433 | 7/1977 | Kirk | 188/25 |
| 4,275,895 | 6/1981 | Edwards | 280/11.2 |
| 4,943,072 | 7/1990 | Henig | 280/11.2 |
| 5,183,275 | 2/1993 | Hoskin | 280/11.2 |
| 5,226,673 | 7/1993 | Cech | 280/11.2 |
| 5,351,974 | 10/1994 | Cech | 280/11.2 |
| 5,375,859 | 12/1994 | Peck et al. | 280/11.2 |
| 5,388,844 | 2/1995 | Pellegrini et al. | 280/11.2 |

These prior art braking devices apply the braking forces to a single rotating member. First of all, this limits the amount of braking forces that can be applied to the skate. Secondly, the heat generated by the braking device is typically absorbed in the braking device itself which heats the skate wheel because of the contact between the skate wheel and the braking device. Because relatively large amounts of heat are generated and because the skate wheels are usually made of a resilient elastomer material, these prior art braking devices frequently damaged the skate wheel against which the braking forces were applied. Moreover, the limited heat dissipation achieved with these prior art systems contributed to increased wear of the braking device itself. As a result, the prior art has not been able to adequately brake in-line roller skates.

SUMMARY OF THE INVENTION

These and other problems and disadvantages associated with the prior art are overcome by the invention disclosed herein by providing a temperature control system for rotating members which provides rapid heat transfer from the heated members thereby minimizing the size of such system. The temperature control system is simple in construction so as to be inexpensive to manufacture and use. Moreover, the invention provides a brake mechanism for in-line roller skates which is capable of applying large magnitude braking forces to the skate wheels without excessive wear to the brake pad and/or the skate wheels, which distributes the braking forces equally between at least a pair of the skate wheels to effectively reduce the per wheel stopping forces required to stop the in-line roller skate, and which isolates the heat generated by braking from the skate wheels so as to prevent excessive wear and/or damage thereto. The invention also reduces the vibrations transmitted to the wearer through the skates, permits greater control over the application of the braking forces by the user, and automatically varies the contact force between the roller skate wheel and the brake proportional to the magnitude of the braking forces being generated to provide improved safety of operation.

The invention is directed to a system for engaging a pair of rotating members such as skate wheels on in-line roller skates and may be used to apply braking forces to these rotating members. The invention also is directed to braking method which lends itself to the braking of in-line roller skates as well as other applications involving the braking of rotating members. The invention is also directed to a temperature system for rotatable members which lends itself to the cooling of rotating heated members such as brake drums and discs for various systems including in-line roller skates.

The temperature control system of the invention is directed to cooling a rotating member with a heat transfer fluid such as air. It includes a porous media operatively associated with the rotating member for the flow of the heat transfer fluid therethrough; and flow directing means for directing a flow of the heat transfer fluid through the porous media to transfer heat from the rotating member to the heat transfer fluid thereby cooling the rotating member.

The porous media is preferably heat conductive to assist in the transfer of heat to the heat transfer fluid and in thermal contact with the rotating member. The porous media may comprise a three-dimensional, continuous strand, skeletal network structure defining a reticulated open-cell geometry therein. The parameters for the porous media may include a foam made from metal selected from the group consisting of aluminum, steel, copper, brass, nickel, titanium, magnesium, molybdenum, silver, gold, and alloys thereof. Certain ceramics may also be used. Additionally, the porous media parameters of thickness or radius normal to the heated surface on the rotating member, length parallel to the general flow of the heat transfer fluid therethrough, porosity, and density may be selected to achieve at least about 90% of the cooling rate attainable for the rotating member using the particular porous media. The values of the porous media parameters may be selected so that the temperature of the heat transfer fluid exiting the porous media has risen to a prescribed percentage of the temperature of the porous media itself, particularly when air is the heat transfer fluid. For aluminum foam, the parameters are thickness or radius of about 0.25–0.5 inch; length of about 0.75–2.5 inches, depending on the heat transfer fluid velocity being used; porosity of about 8–50 pores per inch; and a density such that the thermal conductivity is at least about 5 watts/meter-deg. C. In particular, for inline skate applications, a thickness or radius of about 0.5 inch, a length of about 1 inch, a porosity of about 10 ppi, and a density such that the thermal conductivity is about 6.9 watts/meter-deg.C. is preferred.

The temperature control system may also include flow directing means for directing the flow of the heat transfer fluid through the porous media. The flow directing means may include primary duct means defining at least one cooling passage adjacent that surface on the rotating member from which heat is to be transferred, where the cooling passage is sized so that said porous media substantially fills a transverse cross-section of said cooling passage. The rotating member itself may serve as the primary duct means by defining the cooling passage therethrough either axially or radially. The primary duct means may also extend over the heated surface on the rotating member to define the cooling passage between the primary duct means and the heated rotating member. When used on an in-line roller skate, the flow directing means may further include inlet duct means oriented so as to generate a pressure gradient across the porous media as the skater moves forwardly over the skating surface so as to force the air through the porous media.

The engaging mechanism of the invention simultaneously engages a pair of spaced apart rotating members and includes an engaging assembly for engaging the rotating members, mounting means for mounting the engaging assembly adjacent the rotating members, and actuation means for causing the engaging assembly to engage the periphery of the rotating members. The engaging mechanism may also include braking means for applying a braking force to the engaging assembly so that the engaging assembly retards the rotation of the rotating members when the actuation means forces the engaging assembly against the rotating members. The engaging mechanism may also include temperature control means for cooling the engaging assembly. The invention also includes the application of the engaging mechanism to an in-line roller skate.

The engaging assembly defines a peripheral rotating member engaging surface therearound having a diameter greater than the minimum distance between the peripheries of the rotating members. The rotating member engaging surface is adapted to frictionally engage the peripheries of the rotating members so that the engaging assembly is rotated by the rotating members while engaged. The engaging assembly may include a thermally conductive brake assembly defining a brake pad engaging surface thereon for frictional engagement with the braking means. The brake assembly may include a thermally conductive cylindrical brake drum, an annular transfer roller mounted around the brake drum, and insulating means for thermally insulating the transfer roller from the brake drum so that the heat generated by the frictional interface between the brake drum and the braking means tends not to be transferred to the rotating members.

The mounting means mounts the engaging assembly adjacent the peripheries of the rotating members so that the engaging assembly is free to move a limited distance toward and away from both of the rotating members for engagement therewith while rotating about its central axis, while having its central axis maintained generally parallel to the rotational axes of the rotating members, and while keeping the engaging assembly laterally aligned with the rotating members. The mounting means comprises a mounting frame fixedly mounted with respect to the rotating member axes and a leaf mounting assembly carried by the mounting frame rotatably mounting the engaging assembly thereon. The leaf mounting means may include at least one and preferably two elongate leaf members flexible in a first direction and substantially inflexible in a second direction normal to the first direction where the leaf members are mounted so that the second direction is oriented substantially parallel to the axes of rotation of the rotating members, and where the engaging assembly is rotatably mounted to the leaf members so that the leaf members can flex to allow the engaging assembly to move toward and away from the peripheries of the rotating members but the engaging assembly is maintained laterally of the rotating members. The leaf members may be resilient to urge the engaging assembly away from engagement with the rotating members. The lateral alignment means may comprise a pair of opposed side bearing surfaces defined on the engaging assembly oriented normal to the engaging assembly central axis; and a pair of opposed side locating surfaces defined on the mounting means adapted to cooperate with the side bearing surfaces on the engaging assembly to laterally locate the engaging assembly. A thrust bearing washer may be positioned between the side locating surfaces and the side bearing surfaces to reduce friction.

The actuation means selectively forces the engaging assembly toward the pair of rotating members so that the contact forces between the engaging assembly and the rotating members are substantially equalized. The actuation means may include force multiplying means to increase the output force level of the actuation means to the braking means. It may also include motion multiplying means for increasing the output motion from the actuation means relative to the input motion. For inline roller skate applications, the actuating means may be operated by the pivotal cuff on the skate shoe.

The braking means of the engaging assembly may include arcuate brake pad means for frictionally engaging the cylindrical brake pad engaging surface on the engaging assembly, and flexible pad holder means mounting the brake pad means thereon, where the pad holder means is operatively connected to the mounting means and the actuation means. The actuation means and the mounting means may be constructed and arranged to selectively cause the brake pad means to frictionally engage the engaging assembly while simultaneously forcing the engaging assembly against the peripheries of the skate wheels to brake same.

Secondary limit means to physically limit the lateral movement of the engaging assembly may be provided by the mounting means and engaging assembly. The secondary limit means may include a pair of opposed side bearing surfaces on the engagement assembly that cooperate with a pair of opposed side locating surfaces on the mounting means to laterally locate the engaging assembly.

The inventive method of cooling a rotating member comprises the steps of placing an open-cell heat conductive porous media adjacent the rotating member so that the porous media rotates with the rotating member where the porous media is selected to cause heat to be transferred from the rotating member to a heat transfer fluid passing the porous media so that thermal dispersion enhances the convective heat transfer; and, passing a heat transfer fluid through the porous media at a bulk flow rate sufficient to transfer heat from the rotatable member to the heat transfer fluid. The porous media may be placed adjacent the rotatable member by substantially filling a passage through the rotatable member with the porous media. Likewise, the cooling method may also comprise mounting the porous media on the outside of the rotatable member and placing duct means over the outside of the porous media to form a cooling passage around the rotatable member substantially filled with the porous media. At typical skating speeds, the method of cooling may include generating a pressure gradient across the porous media with a forwardly facing inlet duct to force air through the porous media.

The braking method of the invention for braking a pair of spaced apart members rotating about generally parallel, spaced apart axes comprises the steps of rotatably positioning a brake member between the rotating members so that the brake member is in peripheral contact with both rotating members; restraining the brake member so that the brake member is maintained in lateral alignment with the rotating members while being free to move toward and away from the rotating members; moving the brake member toward the rotating members so that the brake member exerts approximately equal forces on the rotating members; and, applying braking forces to the brake member to resist the rotation thereof so that an approximately equally divided braking forces are applied to the rotating members. The braking method may further comprise the step of cooling the brake member to prevent heat buildup in the braking member during braking so as to deleteriously affect the rotatable members.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 13:
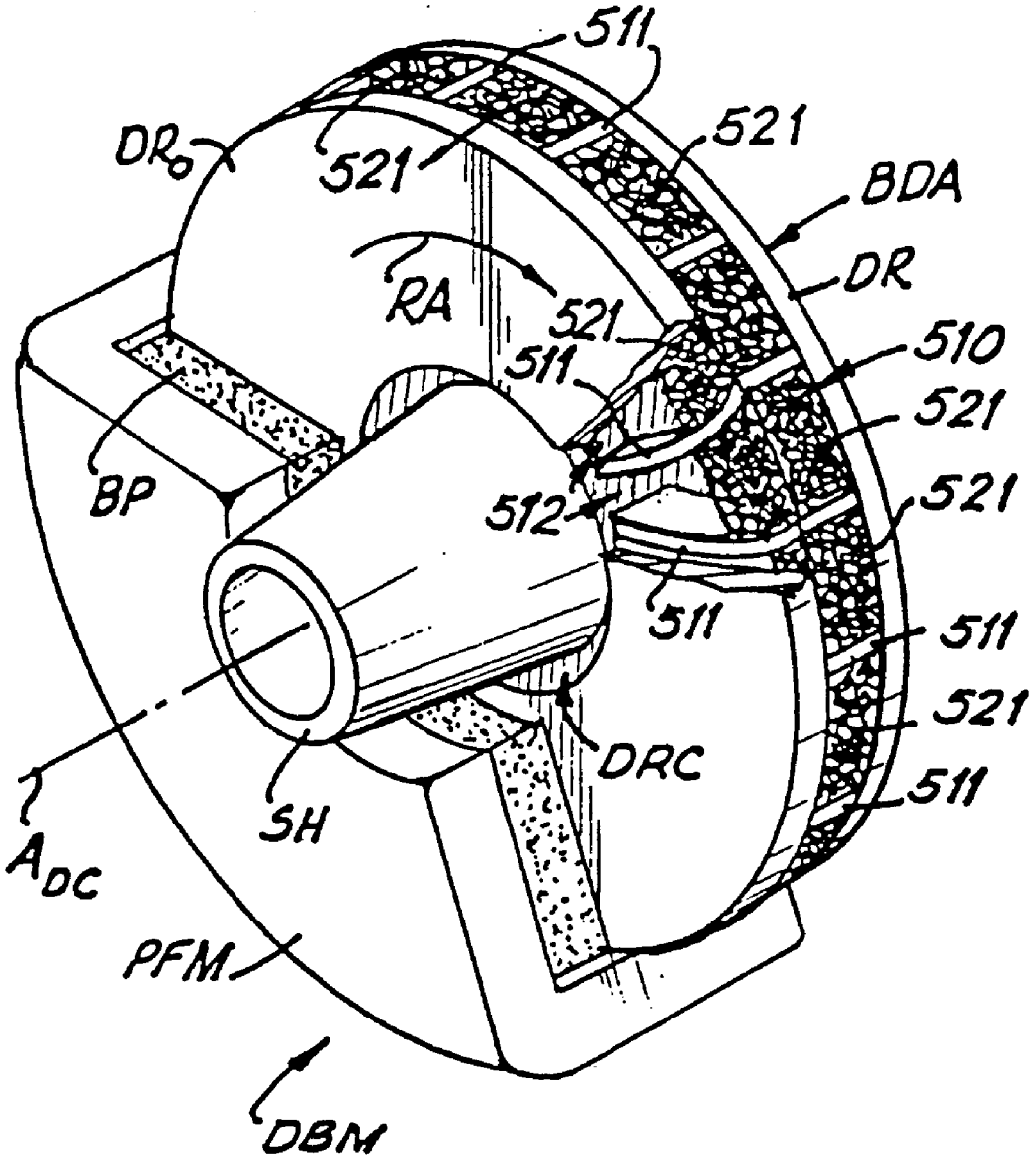
FIG. 13 is a perspective view of a disc brake embodying a second embodiment of the cooling system of the invention; and, FIG. 14 is perspective view of a drum brake embodying a third embodiment of the cooling system of the invention.
Figure 14:
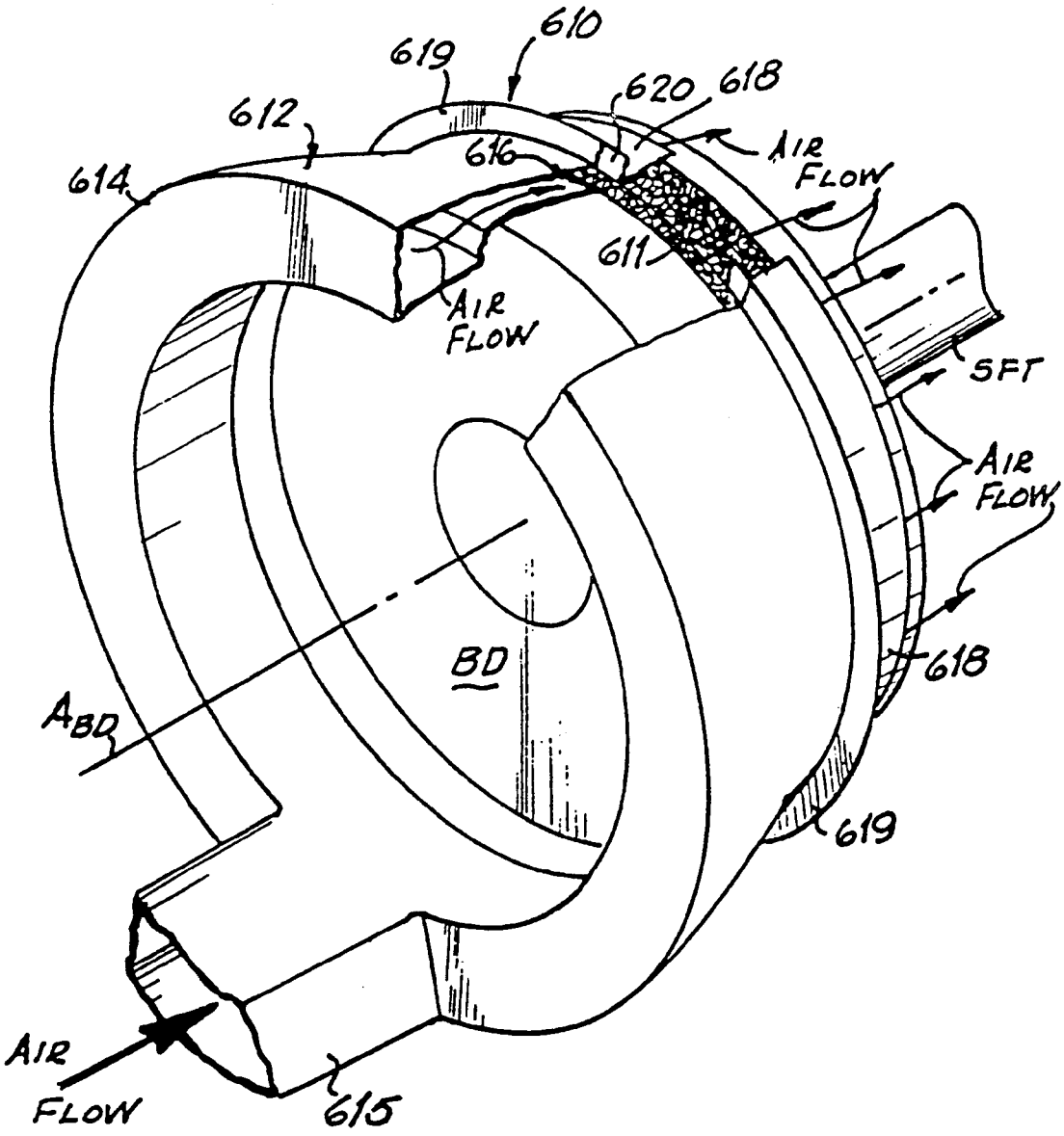

The invention disclosed is directed to a temperature control system for preventing the overheating of a rotating member; and to a mechanism for equalizing the forces exerted against a pair of spaced apart rotating members by an engaging assembly. The engaging mechanism may also be used to apply braking forces to the rotating members. FIGS. 1–7 illustrate a first embodiment 10 of the invention applied to an in-line roller skate RS, FIG. 13 illustrates a second embodiment 510 of the invention applied to a disk brake mechanism DBM while FIG. 14 illustrates a third embodiment of the invention applied to a brake drum BD.

First Embodiment—FIGS. 1–7

Figure 2:
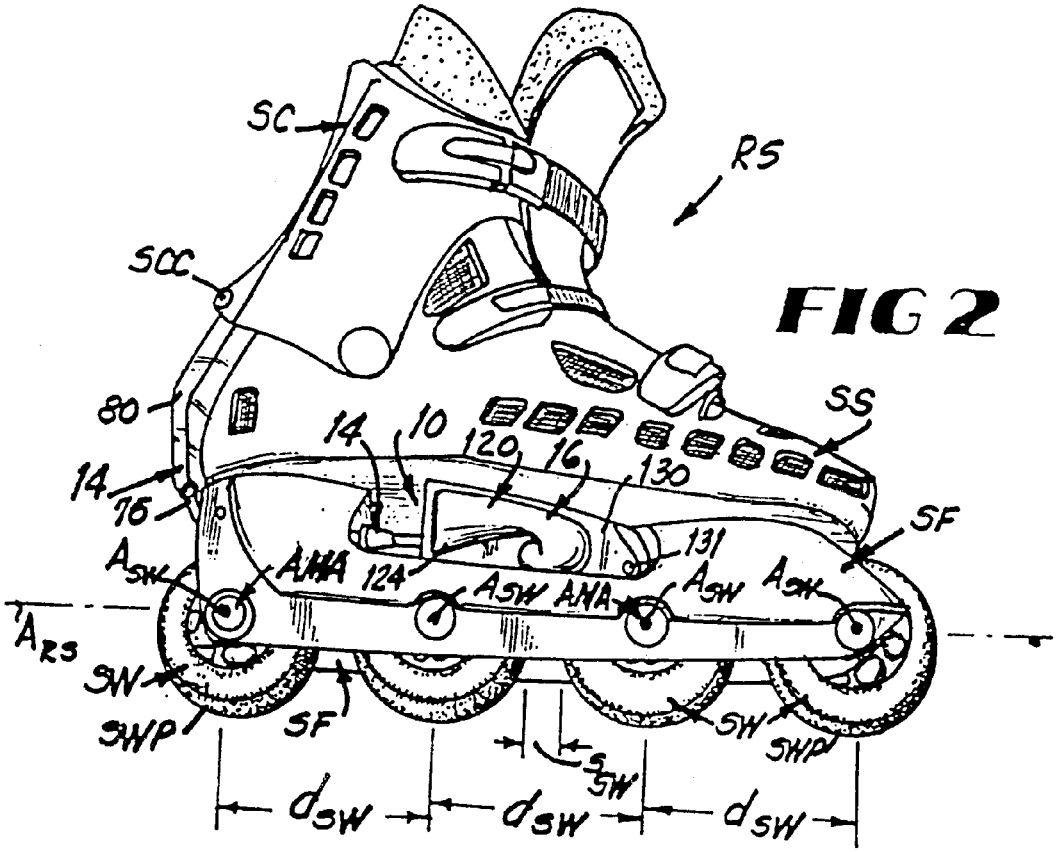
FIG. 2 is a right side perspective of the in-line roller skate of FIG. 1 showing the air outlet.
Figure 1:
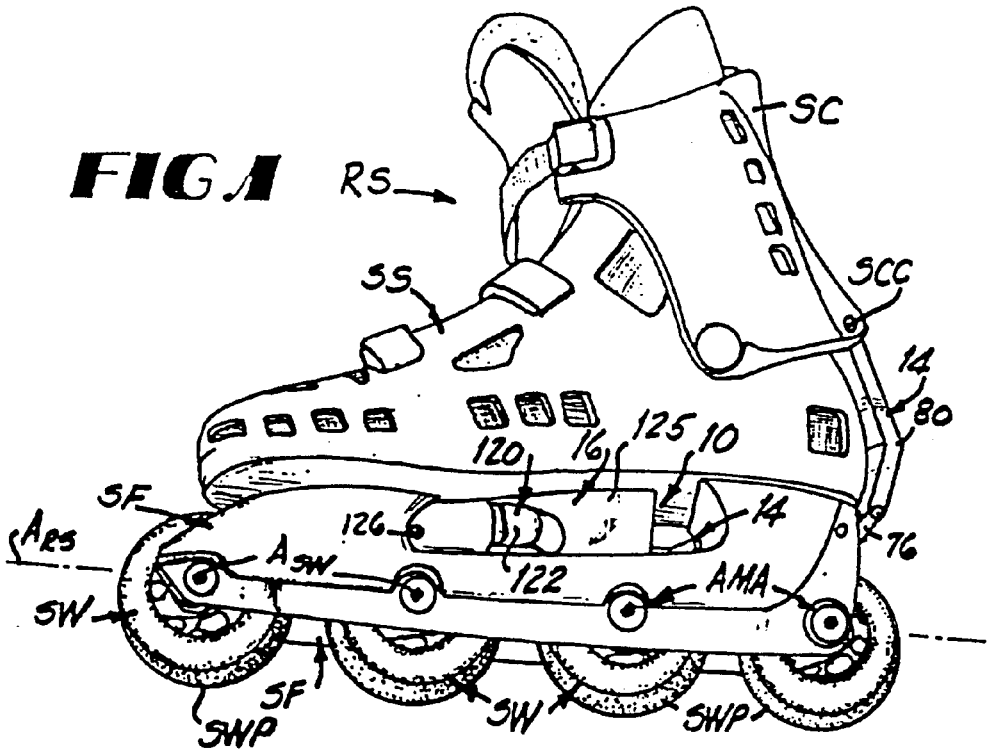
FIG. 1 is a left side perspective of an in-line roller skate embodying the invention and showing the air inlet.

As best seen in FIGS. 1 and 2, the first embodiment 10 is designed to engage a pair of spaced apart rotating members such as the skate wheels SW of an inline roller skate RS through the peripheries SWP thereof, the rotating members rotating about generally parallel rotational axes $A_{SW}$ spaced apart a prescribed distance $d_{SW}$. The embodiment 10 best seen in FIGS. 3–7 includes an engaging assembly 11 frictionally engaging the peripheries SWP of the rotating members SW; mounting means 12 mounting the engaging assembly 11 adjacent the peripheries of the rotating members SW so that the engaging assembly 11 is free to move a limited distance toward and away from both of the rotating members SW; actuation means 14 for selectively forcing the engaging assembly 11 toward the pair of rotating members SW so that the contact forces between the engaging assembly 11 and the rotating members SW are substantially equalized. The embodiment 10 may also include braking means 15 for applying a braking force to the rotating member engaging assembly 11 so that the engaging assembly retards the rotation of the rotating members SW when the actuation means 14 forces the engaging assembly 11 against the rotating members SW. Further, the embodiment 10 may also include temperature control means 16 operatively associated with the engaging assembly 11 and the braking means 15 for preventing overheating of the embodiment 10 or the rotating members SW due to the heat generated by the braking process. It will be appreciated that the temperature control means 16 can be used to cool any rotating member where the temperature is to be controlled to prevent overheating. Likewise, the engaging assembly 11 may be used to transfer any driving or retarding forces to a pair of spaced apart rotating members without departing from the scope of the invention. Also, the braking means 15 may be used to apply braking forces to any moving member regardless of whether the member is moving linearly or rotationally.

As best seen in FIGS. 4–7, the engaging assembly 11 includes a cylindrical tubular brake drum 20 around which is mounted a transfer roller 21. The brake drum 20 is designed to have the braking forces applied thereto by the braking means 15 and is movably mounted by the mounting means 12 adjacent a pair of the rotating members illustrated as the skate wheels SW. The transfer roller 21 is mounted around the outside of the brake drum 20 at a position intermediate its length so that the roller projects outwardly from the brake drum.

The brake drum 20 has an annular side wall 22 defining a central axially extending passage 24 therethrough about the longitudinally extending axis $A_{BD}$ of the drum. Opposite ends of the brake drum 20 are oriented normal to the brake drum axis $A_{BD}$ to define opposed end side engaging surfaces 25 thereon. These surfaces 25 are used to laterally align the drum 20 between the skate side frames SF as will become more apparent. The brake drum 20 has a prescribed length $L_{BD}$ which is slightly less than the transverse distance between the skate side frames SF as will become more apparent so that the brake drum 20 will freely pass between the side frames SF while being oriented so that its central axis $A_{BD}$ is generally horizontal and normal to the skate longitudinal axis $A_{RS}$. The brake drum 20 is preferably heat conductive so that it will transfer heat therethrough to the inside peripheral surface 26 of the side wall 22. The outside peripheral surface on the drum side wall 22 serves as a base on which the transfer roller 21 is mounted.

The roller 21 is mounted on the side wall 22 midway its length so that a pair of cylindrical brake pad engaging surfaces 28 are defined on opposite ends of the outside peripheral surface of the drum side wall 22 outboard of the transfer roller 21. These surfaces 28 are concentric of the drum central axis $A_{BD}$ and centered on a plane normal to the drum central axis $A_{BD}$. These surfaces 28 are frictionally engaged by the braking means 15 to apply braking forces to the engaging assembly 11 and retard its rotation as will become more apparent. As will also become more apparent, the heat generated at the braking means 15/brake pad engaging surfaces 28 interface is transferred through the side wall 22 to the inside surface 26 of the side wall 22. While any convenient material may be used for the brake drum 20, steel has been used satisfactorily to provide the necessary strength to support the forces to which the side wall 22 is exposed, conduct the heat from the surfaces 28 through the side wall 22 to the inside surface 26, and not excessively wear when the frictional braking forces are applied to the surfaces 28.

The transfer roller 21 is an annular cylindrical body 30 with an inside diameter matching that of the outside diameter of the brake drum side wall 22 so that the roller 21 will just slide over the outside of the brake drum 20 and be maintained cocentrically of the brake drum central axis $A_{BD}$ with the roller 21 centered on a plane normal to the drum central axis $A_{BD}$. The transfer roller 21 has an outside diameter $d_{TR}$ which is greater than the clearance space $s_{SW}$ between the adjacent skate wheels SW as seen in FIG. 3 so that the engaging assembly will not pass down between the skate wheels SW but rather will engage the peripheries SWP of the two skate wheels.

Figures 6, 7:
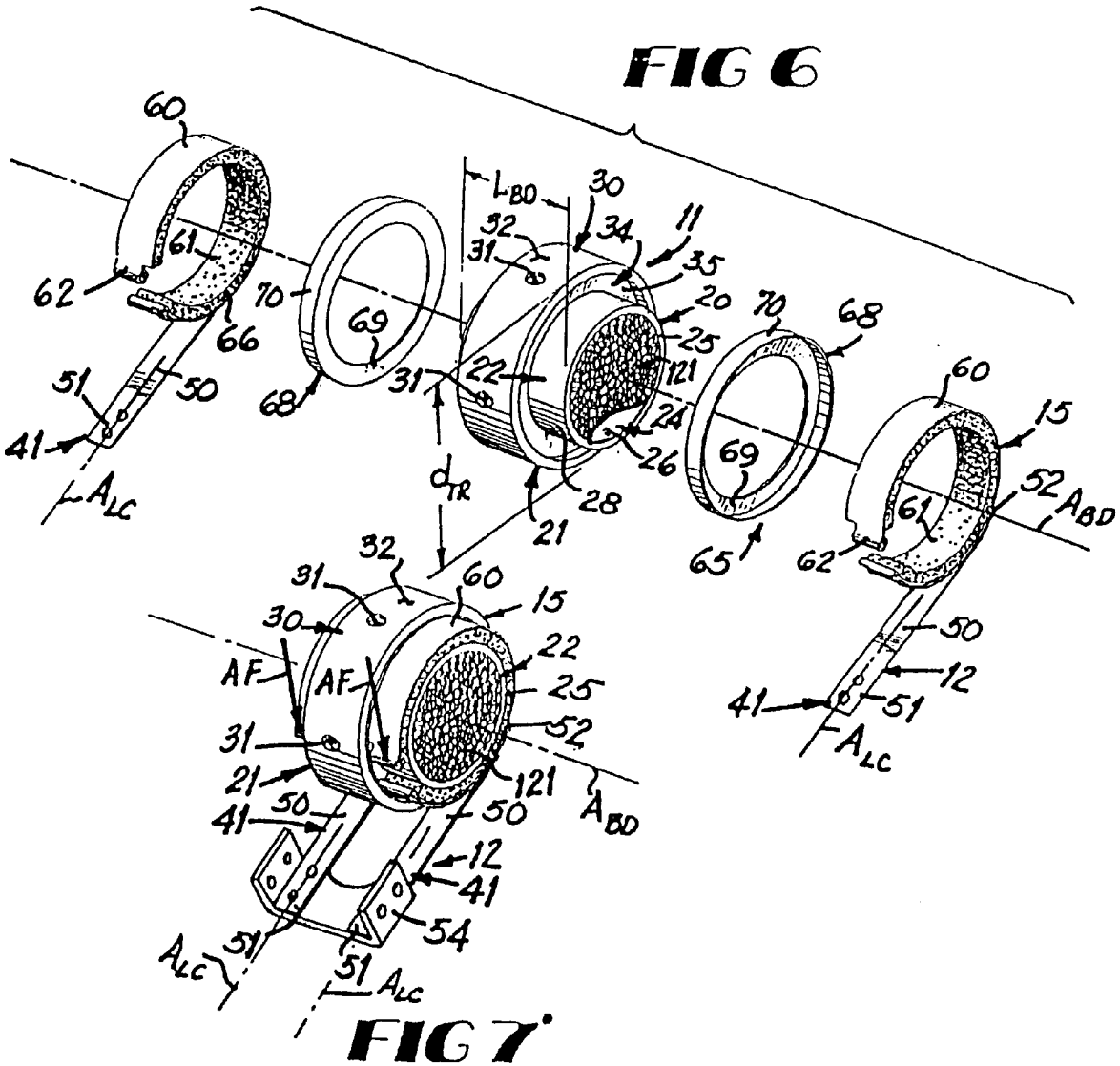
FIG. 6 is an enlarged exploded perspective view of the engaging assembly and braking means of the invention.
FIG. 7 is a perspective view similar to FIG. 6 showing the engaging assembly and braking means assembled.

The transfer roller 21 is attached to the brake drum 20 with fasteners 31 that are recessed below the cylindrical peripheral rotating member engaging surface 32 on the transfer roller 21 as best seen in FIG. 6. The transfer roller 21 defines a pair of annular recesses 34 in the opposite ends thereof with each forming a side bearing surface 35 in the innermost end of the recess 34 that extends around the brake drum 20 adjacent the outer periphery thereon and is oriented to lie in a plane normal to the brake drum central axis $A_{BD}$. These side bearing surfaces 35 form part of the lateral alignment arrangement to maintain the engaging assembly 11 in position laterally of the skate side frames SF.

The transfer roller 21 is designed so as to thermally isolate the rotating member engaging surface 32 thereon from the brake drum 20. The roller 21 may be made in multiple components with at least one component being an insulator. The roller 21 is illustrated as being made out of an insulating material such as phenolic which has worked satisfactory for inline skates. Because of the insulating capacity of the phenolic, the heat from the brake drum 20 tends not to be transferred to the skate wheels SW through the transfer roller 21 when the roller 21 is in contact with the periphery of the skate wheels.

Figures 3, 5:
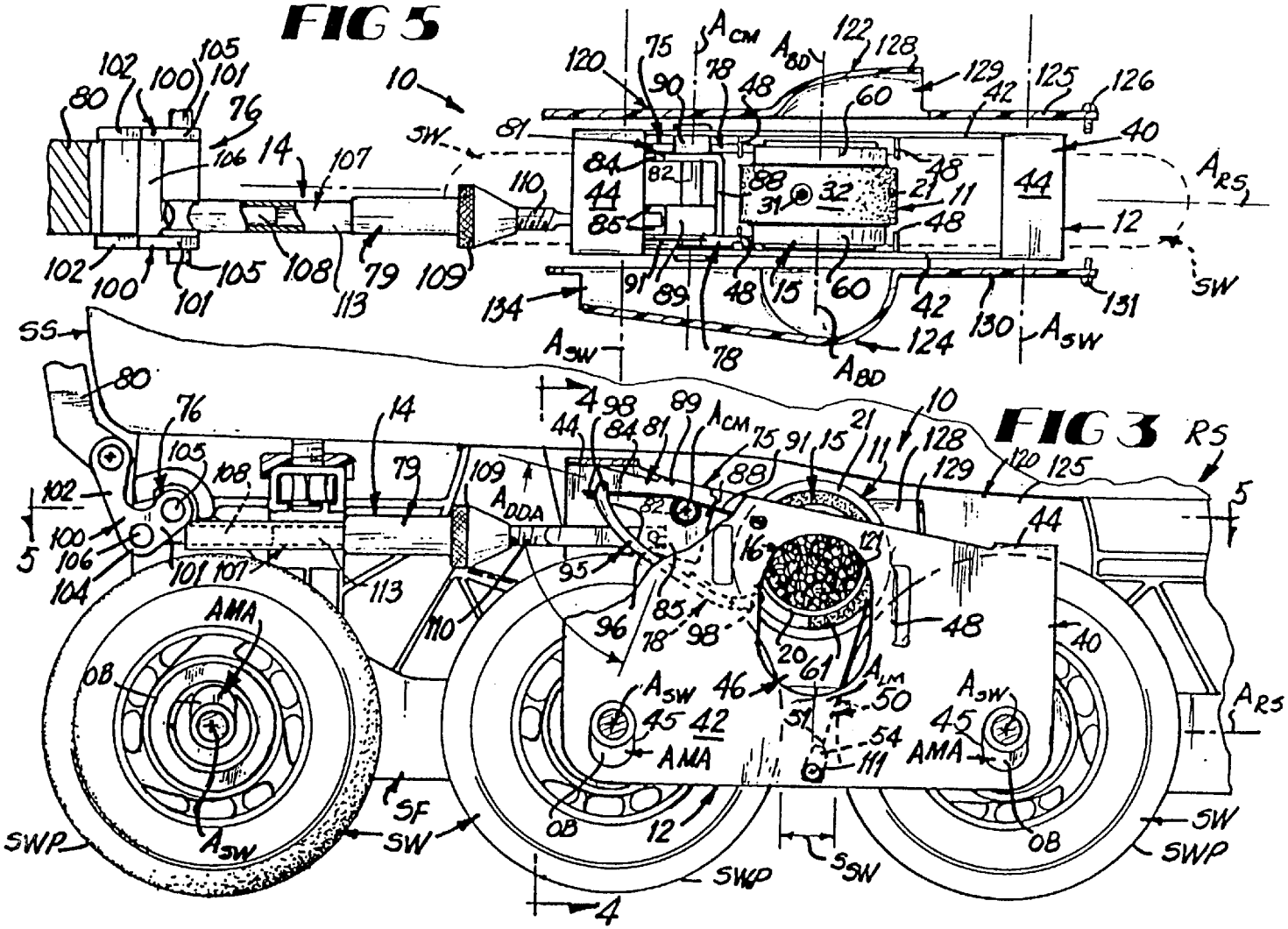
FIG. 3 is an enlarged longitudinally extending vertical cross-sectional view taken just inside the right skate side frame.
FIG. 5 is a horizontal view taken generally along line 5—5 in FIG. 3.
Figure 4:
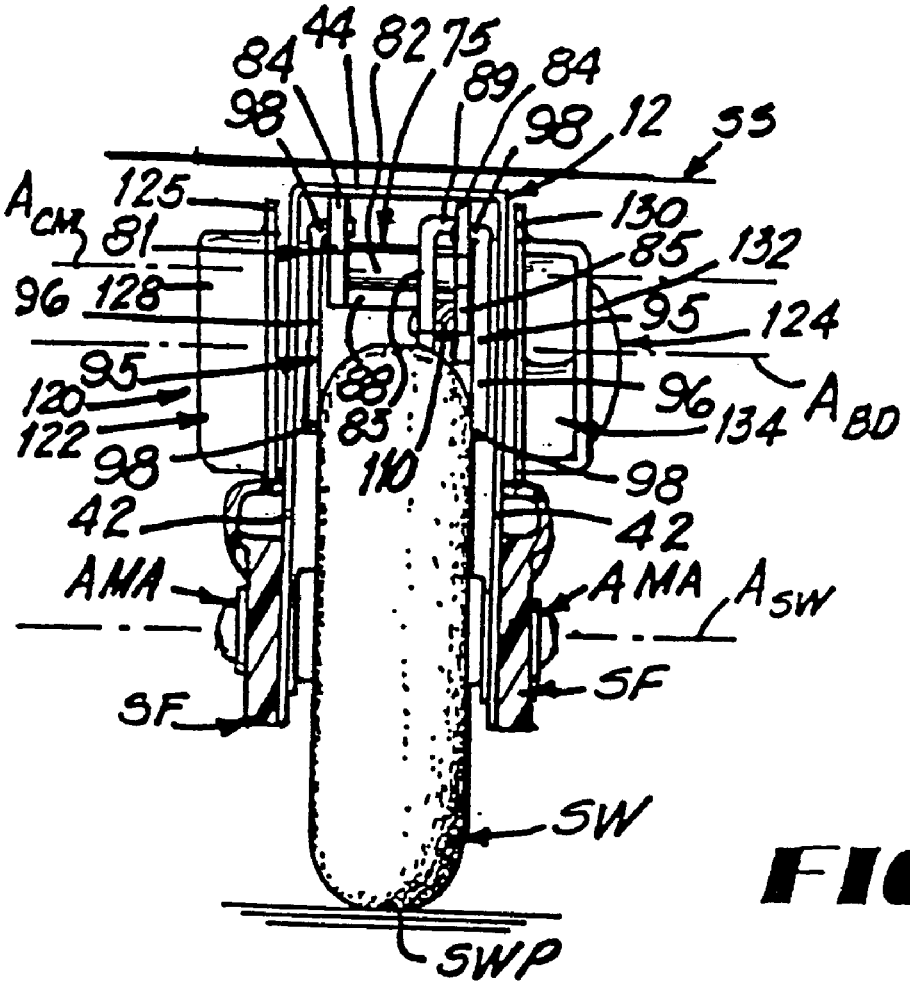
FIG. 4 is a vertical cross-sectional view taken generally along line 4—4 in FIG. 3.

The mounting means 12 includes generally a mounting frame 40 best seen in FIGS. 3–5 which fits between the side frames SF of the skate RS and a leaf mounting assembly 41 best seen in FIGS. 6 and 7 mounted in the frame 40. The two skate wheels SW which are to be engaged by the engaging assembly 11 project into the frame 40, and the engaging assembly 11 is mounted by the leaf mounting assembly 41 within the frame 40 above the skate wheels SW.

The mounting frame 40 includes a pair of side plates 42 adapted to fit against the inside of the side frames SF and be carried by the axle mounting arrangement AMA mounting the skate wheels SW. This serves to positively fix the mounting frame 40 with respect to the skate wheels SW and thus positively locate the engaging assembly 11 as will become more apparent.

The upper edges of the side plates 42 are joined at their leading and trailing ends by cross plates 44 as best seen in FIGS. 3–5. The plates 42 are oriented generally vertically and parallel to each other when the frame 40 is in position between the side frames SF and are spaced apart a distance slightly greater than the length $L_{BD}$ of the brake drum 20 so that the brake drum 20 is freely rotatable about its axis $A_{BD}$, and is movable vertically between the side plates 42. The brake drum 20 is also movable forwardly and rearwardly horizontally generally along the skate longitudinal axis $A_{RS}$, but is restrained against horizontal movement in a direction normal to the skate longitudinal axis $A_{RS}$ by the side plates 42 themselves. The side plates 42 also help dissipate any heat transferred thereto from the engaging assembly 11 by the air passing thereover as the skater moves over the skating surface.

Each of the side plates 42 is provided with a pair of spaced apart eccentric holes 45 which fit over the offset bushings OB of the axle mounting arrangement AMA typically found in inline roller skates as best seen in FIG. 3. The upper central portion of each of the side plates 42 is provided with an air circulation opening 46 located and sized so that the openings 46 will remain in registration with the passage 24 through the brake drum 20 as will become more apparent. Leading and trailing guide flanges 48 best seen in FIG. 5 are provided on each of the side plates 42 and spaced on opposite sides of the opening 46 in the plate 42 so as to insure that the brake drum 20 generally remains in registration with the opening 46 as the brake drum 20 moves toward and away from the peripheries SWP of the skate wheels.

The leaf mounting assembly 41 and braking means 15 best seen in FIGS. 6 and 7 are combined so as to both position the engaging assembly 11 and also apply braking forces thereto. The leaf mounting assembly 41 includes a pair of elongate flat resilient leaf members 50 which can be resiliently flexed easily in one plane but not in the other. Each of the leaf members 50 has a transverse width slightly less than the distance the end of the brake drum 20 projects out past the transfer roller 21 so that when the leaf member 50 is oriented parallel to the side plates 42 and adjacent one of them, the leaf member 50 will just clear the end edge of the transfer roller 21. Each leaf member 50 has a connector end 51 and a projecting pad support end 52. The connector end 51 of each leaf member is fixedly mounted on a connector 54 pivotally mounted between the opposed side plates 42 of the frame 40 below the air circulation openings 46 so that the leaf members 50 angle upwardly at an angle $A_{LM}$ of about 30–40° from the vertical illustrated in FIG. 3.

This locates the leaf members 50 adjacent the side plates 42 so as to provide clearance for the skate wheels SW and the transfer roller 21 on the engaging assembly 11. The leaf members are oriented so that their longitudinal centerlines $A_{LC}$ seen in FIGS. 6 and 7 can move in a vertical plane as the leaf members flex but lateral movement of the leaf members so that the centerlines $A_{LC}$ move away from the vertical plane are substantially prevented. As will become more apparent, this helps keep the engaging assembly 11 in lateral registration with the skate wheels SW and centered between the side plates 42 of the mounting frame 40.

A flexible arcuate brake pad holder 60 seen in FIGS. 6 and 7 is mounted on the projecting end 52 of each leaf member 50 and is also oriented about a generally vertical plane. Each brake pad holder 60 is designed to encircle a major portion of the cylindrical brake pad engaging surface 28 on the end portion of the brake drum 20 and a similarly shaped brake pad means 61 is affixed to the inside of the brake pad holder 60 to frictionally engage the surface 28 on the brake drum. The projecting end 52 of the leaf member 50 is attached to a point on the outside of the holder 60 that is nearer one end of the holder 60 than the other. The distal end of the holder 60 as seen in FIGS. 6 and 7 is provided with a connector loop 62 for connection to the actuation means 14 as will be explained.

The leaf mounting assembly 41 also includes part of the lateral alignment arrangement 65 that keeps the engaging assembly 11 laterally centered between the side plates 42 of the mounting frame 40. The inwardly facing side edges 66 of both the brake pad holder 60 and the brake pad 61 form a bearing surface that engages a thrust washer 68 that fits into the recess 34 on the transfer roller 21 facing the edges 66. The thrust washer 68 has a planar annular flange 69 forming the plane of the washer which bears against the side bearing surface 35 in the recess 34 and an annular lip 70 integral with the outside edge of the flange 69 and oriented normal to the plane of the flange 69 to help retain the washer 68 in the recess 34 and prevent the brake pad holder 60 from engaging the transfer roller 21 and damaging it. The lip 70 also helps maintain the shape of the brake pad holder 60 as it flexes when the braking forces are applied to the brake drum 20 as will become more apparent.

The lateral alignment arrangement 65, then, includes the edges 66 on the brake pads 61 and holder 60 that engage the side bearing surfaces 35 on the transfer roller 21 through the thrust washer 68. The lateral alignment arrangement 65 also includes the end side engaging surfaces 25 on opposite ends of the brake drum 20 that engage the inside surfaces of the side plates 42. This keeps the outside surface 32 on the transfer roller 21 laterally aligned with the peripheries SWP on the adjacent pair of skate wheels SW as seen in FIG. 5.

The braking means 15 includes the brake pads 61 and the brake pad holders 60. When an actuation force AF illustrated in FIG. 7 is applied that forces the projecting end of the pad holder 60 downwardly and toward the leaf members 50, the brake pads 61 are tightened against the peripheral brake pad engaging surfaces 28 on opposite ends of the brake drum 20 to apply braking forces to the brake drum 20 and resist rotation of the brake drum 20. At the same time, the engaging assembly 11 is forced downwardly toward the skate wheels SW so that the peripheral surface 32 on the transfer roller 21 frictionally engages the peripheries SWP on the two skate wheels SW to be braked sufficiently for the skate wheels SW to rotationally drive the engaging assembly 11. Thus, the braking forces resisting rotation of the engaging assembly 11 are transferred to the skate wheels SW to effectively brake the skate wheels. Because of the flexibility of the leaf members 50 and the pad holders 60, the engaging assembly 11 can shift forwardly or rearwardly in the direction of the skate centerline $A_{RS}$ until the braking forces are equally divided between the pair of skate wheels SW. Thus, this arrangement is not only automatically compensating for skate wheel and transfer roller wear, it also insures equal division of the braking forces between the skate wheels being braked. By dividing the braking forces between two skate wheels, larger braking forces can be applied without sliding the skate wheels and also excessively loading either of the skate wheels so as to extend the life of the skate wheels themselves. This also reduces the wear to the transfer roller by reducing the frictional force level to be applied at a single point on the roller periphery.

The actuation means 14 is illustrated as being driven by the pivotal cuff SC on the skate RS in FIGS. 1 and 2, however, it is to be understood that various arrangements may be utilized to provide the actuation forces necessary to operate the braking means 15. Examples of alternate actuation means are hand held actuation devices and ground engaging pads or rollers attached to the skate itself.

The actuation means 14 illustrated includes a motion multiplying pivot assembly 75 mounted in the mounting frame 40 and connected to the connector loops 62 on the projecting ends on the brake pad holders 60 through a dual rod linkage 78 best seen in FIGS. 3–5. The actuation means 14 also includes a force multiplying pivot assembly 76 mounted between the side frames SF of the skate RS at the rear ends thereof so as to be accessible from the rear of the skate RS. The force multiplying pivot assembly 76 is connected to the motion multiplying assembly 75 by an adjustable rod linkage 79 and is also connected to the lower rear portion of the pivotal cuff SC by a drive link 80 as seen in FIGS. 1–3. When the cuff SC is pivoted in a clockwise direction as seen in FIG. 2, the braking forces will be applied to the skate wheels SW.

The motion multiplying pivot assembly 75 seen in FIGS. 3–5 includes a crank member 81 pivotally mounted on pivot pin 82 extending through the upper trailing portions of the side plates 42 above the trailing skate wheel SW of the pair of skate wheels which are to be braked. The crank member 81 includes a pair of drive legs 84 that extend outwardly from the pivot axis $A_{CM}$ of the crank member 81 as defined by the pin 82. The axis $A_{CM}$ is oriented generally parallel to the axes $A_{SW}$ of the skate wheels SW and the axis $A_{BD}$ of the brake drum 20 when it is in operative position in the mounting frame 40. The crank member 81 also has a pair of driven legs 85 that extend outwardly from the pivot axis $A_{CM}$ at an included angle $A_{DDA}$ with respect to the drive legs 84 as best seen in FIG. 3. The adjustable rod linkage 79 is connected to the projecting ends of the driven legs 85 while the dual rod linkage 78 is connected to the projecting ends of the drive legs 84. The effective distance from the axis $A_{CM}$ to the rod linkage 79 connection to the driven legs 85 is less than the corresponding distance to the rod linkage 78 connection to the drive legs 84 so that movement of the driven legs 85 through a prescribed arc around the axis $A_{CM}$ produces a greater linear movement of the dual rod linkage 78 connection with legs 84 than the rod linkage 79 connection with legs 85 has moved. This insures sufficient movement of the linkage 78 to always apply the braking forces necessary to stop the skate RS while compensating for wear and skate wheel mounting adjustment.

The inboard ends of the legs 84 are connected by a tie plate 88 while the inboard ends of the legs 85 are connected by a tie plate 89 to reinforce the respective legs and also maintain a prescribed spacing between the legs. The distance between the outboard sides of the drive legs 84 is a prescribed amount less than the distance between the side plates 42 of the mounting frame 40 so that a clearance space is provided between each of the legs 84 and the adjacent side plate 42 as best seen in FIG. 5. An appropriate spacer 90 is positioned around the pivot pin 82 between one side of the crank member 81 and the adjacent side plate 42 while a return spring 91 is positioned around the pivot pin 82 between opposite side of the crank member 81 and the adjacent side plate 42 to maintain the spacing between the crank member and the side plates. The return spring 91 is constructed and arranged to urge the crank member 81 clockwise (as seen in FIG. 3) and the braking means 15 toward the released position shown in FIG. 3 while the adjustable rod linkage 79 is used to pivot the crank member 81 in a counterclockwise direction to move the engaging assembly 11 downwardly to an engaged position where the surface 32 on the transfer roller 21 is engaging the peripheries SWP of the skate wheels SW. In the released position, the engaging assembly 11 is usually just clearing the skate wheels SW as seen in FIG. 3 so that the skate wheels SW are freely rotatable but lie closely adjacent the skate wheels so that very little movement is required to engage the engaging assembly 11.

The dual rod linkage 78 includes a pair of drive rods 95, one connecting the projecting end of one of the drive legs 84 on the crank member 81 to one of the connector loops 62 on the end of one of the brake pad holders 60 while the other connects the projecting end of the other drive leg 84 on the crank member 81 to the other connector loop 62 on the end of the other brake pad holder 60. Each of the drive rods 95 has a curved base section 96 lying in a flat plane with a normally extending short connector section 98 on each of the opposite ends of the base section 96 that are oriented normal to the plane of the base section 96. The diameters of the rods 95 are such that the central curved section 96 will just fit between the outside of the drive legs 84 and the side plates 42 with the connector sections 98 fitted into the connector loops 62 on the ends of the brake pad holders 60 and into the projecting ends of the drive legs 84. This maintains the connections between drive rods 95, the drive legs 84 and the brake pad holders 60.

The force multiplying linkage 76 seen in FIGS. 3 and 5 includes a pair of bellcrank members 100 with a short arm 101 and a longer arm 102 joined at an apex 104. The projecting ends of the short arms 101 are pivoted to the side frames SF of the skate with a pivot pin 105 while the apexes 104 are pivotally connected to the adjustable rod linkage 79 through pivot pin 106. The projecting ends of the long arms 101 are pivotally connected to the drive link 80 so that a greater force is outputted to the motion multiplying pivot assembly 75 than is inputted through the drive link 80.

The adjustable rod linkage 79 has a slip connection arrangement 107 which permits the cuff SC to freely pivot as the skater skates even though the motion multiplying pivot assembly 75 stops moving when the arms 84 abut the cross plate 44. The slip connection arrangement 107 includes a base rod section 108 with one end connected to the pivot pin 106 on the pivot assembly 76 and projecting forwardly toward the engaging assembly 11. The projecting end of the base rod section 108 slides up into a slip tube 113 so that the slip tube 113 can slide toward the pivot pin 106 in the pivot assembly 76 until the end of the tube 113 abuts the pivot pin 106. The opposite end of the slip tube 113 is fixedly mounted on a manually operated nut member 109 that threadedly engages the trailing end of the extension rod section 110. The forward end of the extension rod section 110 is pinned to the projecting ends of the driven legs 85 of the pivot assembly 75. As the pivot assembly 76 is rotated counterclockwise by the drive linkage 80 as seen in FIG. 3, the rod 108 slides up into the tube 113 until the pivot pin 106 abuts the end of the tube 113. As the pivot assembly 76 continues to rotate counterclockwise, the pin 106 forces the slip tube 113 to the right as seen in FIG. 3 thereby pivoting the pivot assembly 75 to apply the braking forces to the skate wheels. Since the base rod 108 and the slip tube 113 are circular in cross-section, the tube 113 is free to rotate with the nut member 109 for length adjustment of the linkage 79. Thus, manually adjusting the nut member 109 adjusts the pivotal position of the motion multiplying pivot assembly 75 relative to the position of the force multiplying pivot assembly 76 when motion is transferred to the assembly 75 from the assembly 76. This serves to set the amount of movement of the cuff SC before the engaging assembly 11 is moved relative to the skate wheels SW. Another advantage of the slip connection arrangement 107 is that all of the mechanism 10 forward of the pivot assembly 76 can be removed and replaced as a unit quite easily. When the skate wheel axles are removed, the mounting frame 40 can be removed with the engaging assembly 11, the leaf mounting assembly 41 and the pivot assembly 75 still mounted in the frame 40. The tube 113 simply slips off of the end of the base rod 109. The mechanism 10 can be replaced in the same manner.

The drive link 80 is an elongate member with an offset central section to clear the rear of the skate shoe SS as it is moved up and down with respect to the shoe. The upper end of the link is pinned to the connector SCC on the skate cuff SC seen in FIGS. 1 and 2 and the lower end is pinned to the projecting ends of the longer arms 102 of the bellcrank members 100. Thus, as the user pivots the cuff SC counterclockwise as seen in FIG. 2, the cuff SC moves the link 80 downwardly. This rotates the bellcrank members 100 of the pivot assembly 76 counterclockwise as seen in FIG. 3 to shift the adjustable rod linkage 79 forwardly relative to the skate RS and rotate the crank member 81 of the pivot assembly 75 counterclockwise. The counterclockwise rotation of the pivot assembly 75 urges the dual rod linkage 78 downwardly and forwardly to tighten the brake pads 61 around the brake drum 20 so as to brake the rotation of the drum and also force the engaging assembly 11 down against the peripheries SWP of the two skate wheels SW being braked.

The leaf mounting assembly 41 is assembled onto the engaging assembly 11 and the dual rod linkage 78 connected between the pivot assembly 75 and the pad holders 61 as seen in FIG. 7. Then the assemblage is installed in the frame 40 by affixing the connector 54 to the side plates 42 of the mounting frame 40 by appropriate means such as the fasteners 111 shown in FIG. 3 and installing the pivot pin 82 between the side plates 42.

The temperature control means 16 serves to dissipate the heat generated at the frictional interface between the brake pads 61 and the brake drum 20 and to thermally isolate the brake drum 20 from the skate wheels SW. The thermal isolation of the brake drum 20 from the skate wheels SW is provided by the insulating capacity of the transfer roller 21 as explained above. A certain portion of the heat generated by braking is transferred to the air flowing through the skate wheel area of the skate by the exposed surfaces of the pad holders 60 and the side plates 42 of the mounting frame 40. The primary heat dissipation is provided by an air flow directing means 120 that serves to direct a flow of air through the passage 24 of the brake drum 20 and a porous media 121 positioned within the passage 24 to enhance the heat transfer between the brake drum 20 and the air flowing therethrough.

The flow directing means 120 seen in FIGS. 1–5 includes an inlet duct arrangement 122 mounted on the side frame SF of the skate RS (here the left side frame) in registration with the passage 24 through the engaging assembly 11 as best seen in FIG. 1 and an outlet duct arrangement 124 mounted on the opposite side frame SF of the skate RS (here the right side frame) in registration with the passage 24 through the engaging assembly 11 as best seen in FIG. 2. The inlet duct arrangement 122 and the outlet duct arrangement 124 generate a pressure differential or gradient across the brake drum 20 so as to induce an air flow through the passage 24.

The inlet duct arrangement 122 seen in FIGS. 1 and 5 includes a baffle 125 which covers the opening above the skate side frame SF in the vicinity of the mounting frame 40 on the left side of the skate RS as seen in FIG. 1 and is held in position by an appropriate fastener 126. An inlet duct 128 is formed in the baffle 125 in registration with the air circulation opening 46 through the frame side plate 42 and has a forwardly opening mouth 129 facing the oncoming air as the skate RS moves forwardly over the skating surface.

The outlet duct arrangement 124 includes a baffle 130 which covers the opening above the skate side frame SF in the vicinity of the mounting frame 40 on the right side of the skate RS as seen in FIG. 2 and is held in position by an appropriate fastener 131. A diverging outlet duct 132 is formed in the baffle 130 in registration with the air circulation opening 46 through the frame side plate 42 and has a rearwardly opening outlet 134 facing away from the oncoming air as the skate RS moves forwardly over the skating surface. The air is picked up by the inlet duct 128, directed through the passage 24 to cool the brake drum 20, and then discharged through the outlet duct 132.

Any porous media 121 may be used in the passage 24 through the brake drum 20 which has the capability of increasing the heat transfer rate between the brake drum 20 and the air passing through the passage 24. It will likewise be appreciated that the air flow induced by the ducts 128 and 132 through the passage 24 will cause the convective heat transfer rate to increase even where the porous media 121 is not present.

The particular porous media 121 being used is a heat conductive three-dimensional network of continuous strands of heat conductive material defining a reticulated open-cell geometry with spaced apart integral strand junctures. This allows the air to pass through the media 121 while heat is conducted away from the brake drum 20. The porosity, density, effective thickness normal to the drum surface 26 along passage 24, effective length parallel to the drum surface 26 along passage 24, unit surface area per unit volume, and the thermal conductivity of the porous media all have an effect on the amount of heat that can be transferred from the brake drum 20 to the air passing along the passage 24. Best results have been obtained using a heat conductive metal for the media 121 and selected from the group consisting of aluminum, steel, copper, brass, nickel, titanium, magnesium, molybdenum, silver, gold, and alloys thereof. Aluminum has worked well for the particular parameters used for the skate applications. One such product is available under the trade name DuoCEL from Energy Research and Generation, Inc. in Oakland, Calif.

In the skate application, the physical size of the space available to mount the embodiment 10 places certain restraints on the parameters that can be used for the porous media 121.

Figure 8:
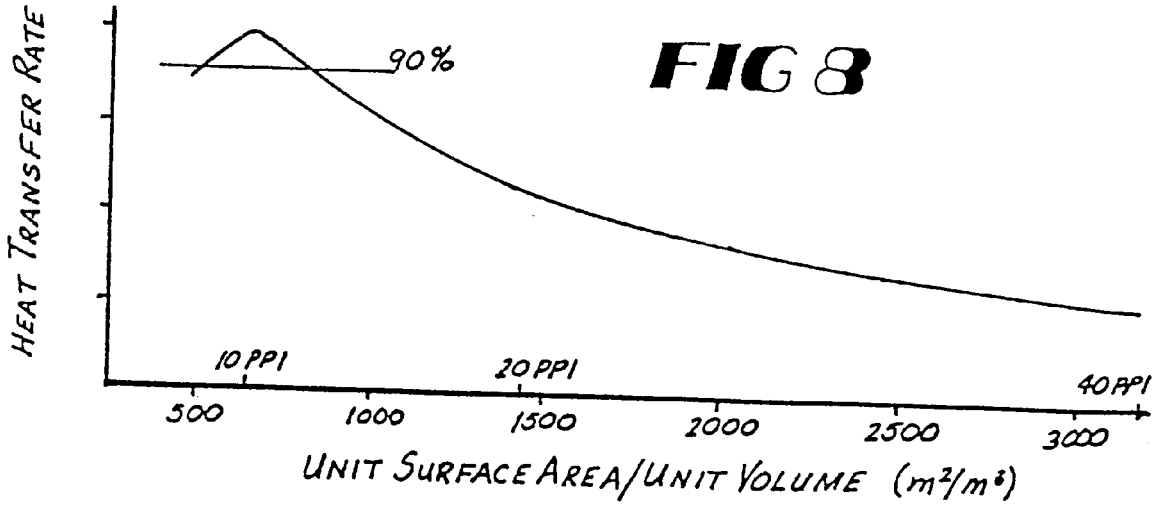
FIG. 8 is a chart relating unit surface area in the porous media to the heat transfer rate.

FIGS. 8–11 interrelate the various parameters to the heat transfer rate between the brake drum 20 and the air passing through the passage 24 at typical skating speeds of about 20 miles per hour (8.9 meters/second). FIG. 8 illustrates the effect of varying surface area on the heat transfer rate. The surface area per unit volume is primarily determined by the porosity of the porous media. The unit surface area is expressed in meter$^2$/meter$^3$ with the corresponding typical porosities noted. From FIG. 8, it will be seen that the maximum heat transfer rate is achieved at a unit surface area corresponding to a porosity of about 10 pores per inch (ppi) for the skate application. The level of about 90% of the maximum heat transfer rate has been marked on FIG. 8 for reference and is achieved for a range of about 8–12 ppi.

Figure 9:
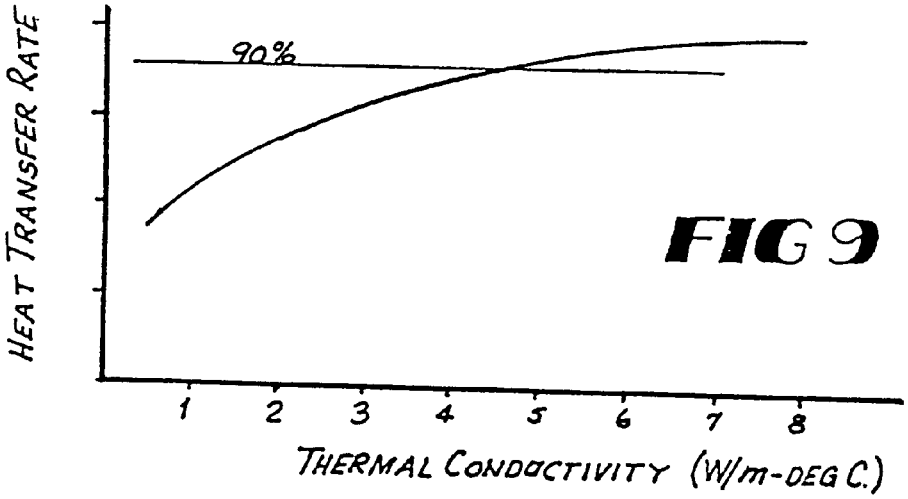
FIG. 9 is a chart relating thermal conductivity in the porous media to the heat transfer rate.

FIG. 9 plots heat transfer rate versus the thermal conductivity of the porous media where the thermal conductivity is expressed in watts per meter per degree C. The thermal conductivity is primarily a function of the density of the media but the density is limited by the porosity of the media. Thus, the thermal conductivity should be maximized for the particular porosity selected for the porous media. The 10 ppi porous media is available at the thermal conductivity showing the maximum heat transfer rate in FIG. 9.

Figure 10:
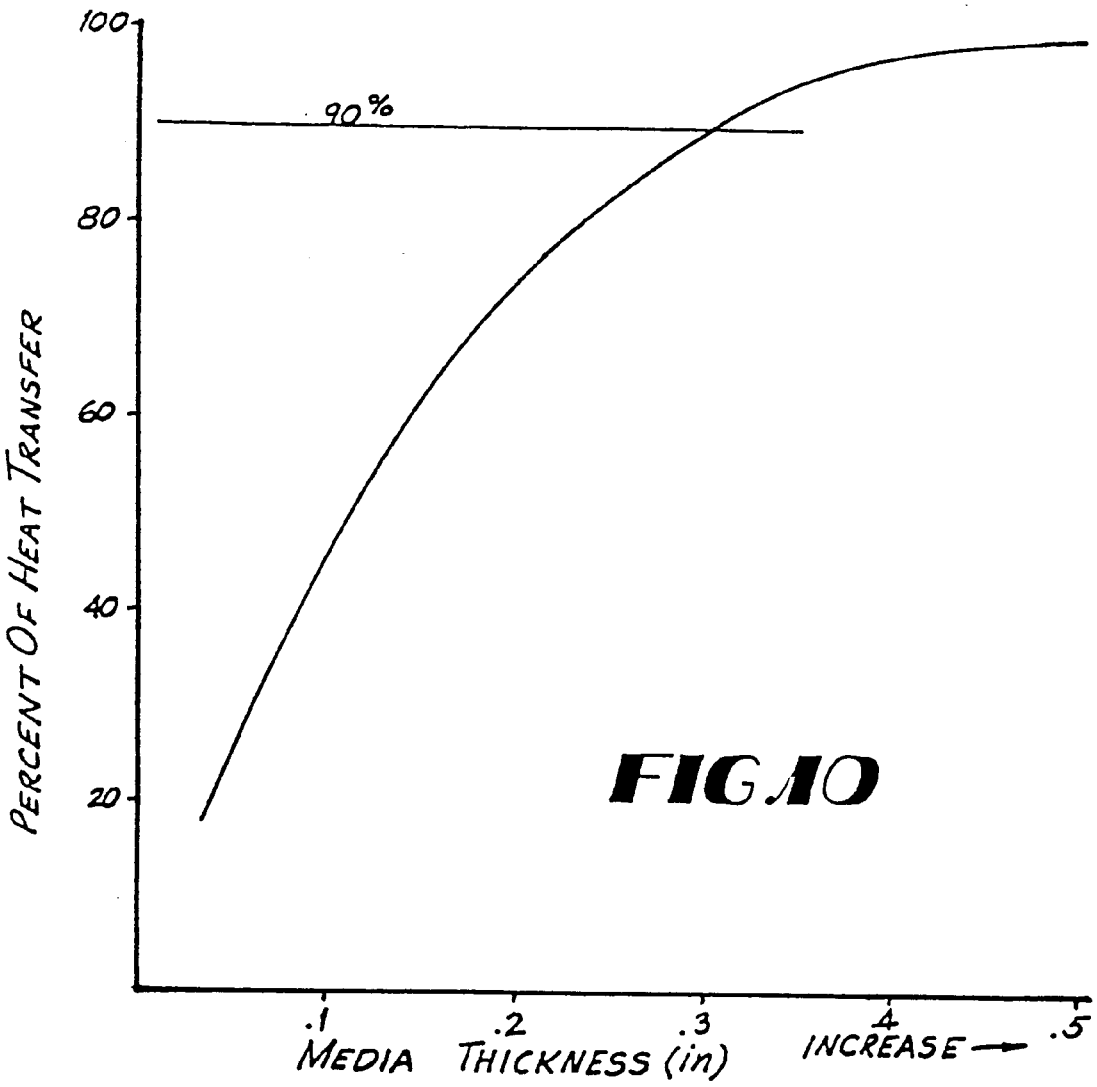
FIG. 10 is a chart relating porous media thickness or radius to the heat transfer rate.

FIG. 10 is a plot relating porous media thickness normal to the heated surface to be cooled to percent of heat transfer rate. The plot is based on a porous media porosity of about 10 ppi. The 90 percent level has been marked for reference and shows that about 90% of the heat is transferred within the first 0.3 inch of media.

Figure 11:
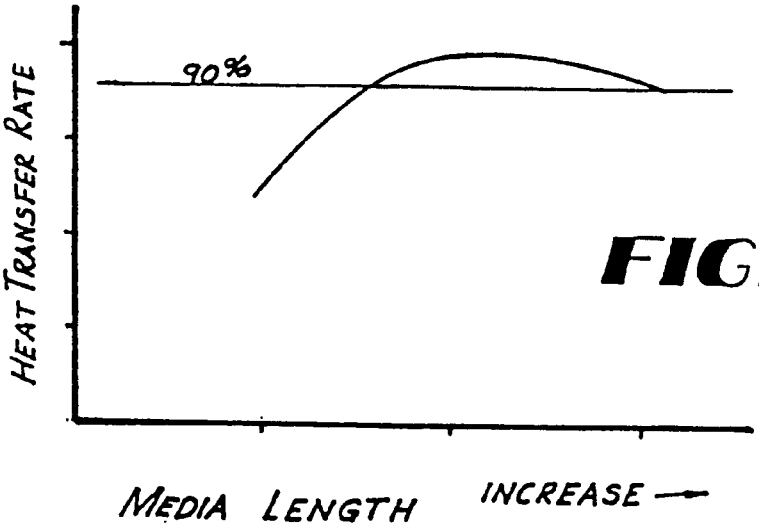
FIG. 11 is a chart relating porous media length to the heat transfer rate.

FIG. 11 is a plot relating porous media length with heat transfer rate. The plot shown is based on porous media with about 10 ppi. The length of the porous media is selected so that the heat transfer rate is at least about 90% of the maximum heat transfer rate available for the particular porous media. The particular length is dependent on the relative flow velocity of the heat transfer fluid through the porous media. For the flow velocities typically encountered with roller skates, maximum heat transfer occurs at about 1 inch, however, higher heat transfer fluid flow velocities increases the length of the porous media at which the maximum heat transfer rate occurs.

For the particular roller skate RS illustrated, the length of the brake drum 20 is limited to about 1 inch while the diameter of the passage 24 is limited to about 0.9–1.0 inch. From the above charts, the porous media 121 should have a porosity of about 8–12 ppi with about 10 ppi preferred; the radial thickness of the porous media should be at least about 0.3 inch and less than about 0.5 inch; and the porosity and density of the media 121 should be selected so that the thermal conductivity is at least 5 W/m-deg C. In the particular example shown, the porous media has a porosity of about 10 ppi, a thermal conductivity of about 7 W/m-deg. C., and a length of about 1 inch while the passage 24 is filled with the porous media at a diameter of about 0.9 inch.

While not optimum, it will appreciated that other types of porous media such as metal wool and bristled members may be used without departing from the scope of the invention. These alternative media may be used where the required heat transfer rate to keep the brake drum cooled is less than that for which the described example is designed.

Alternate Version

Figure 12:
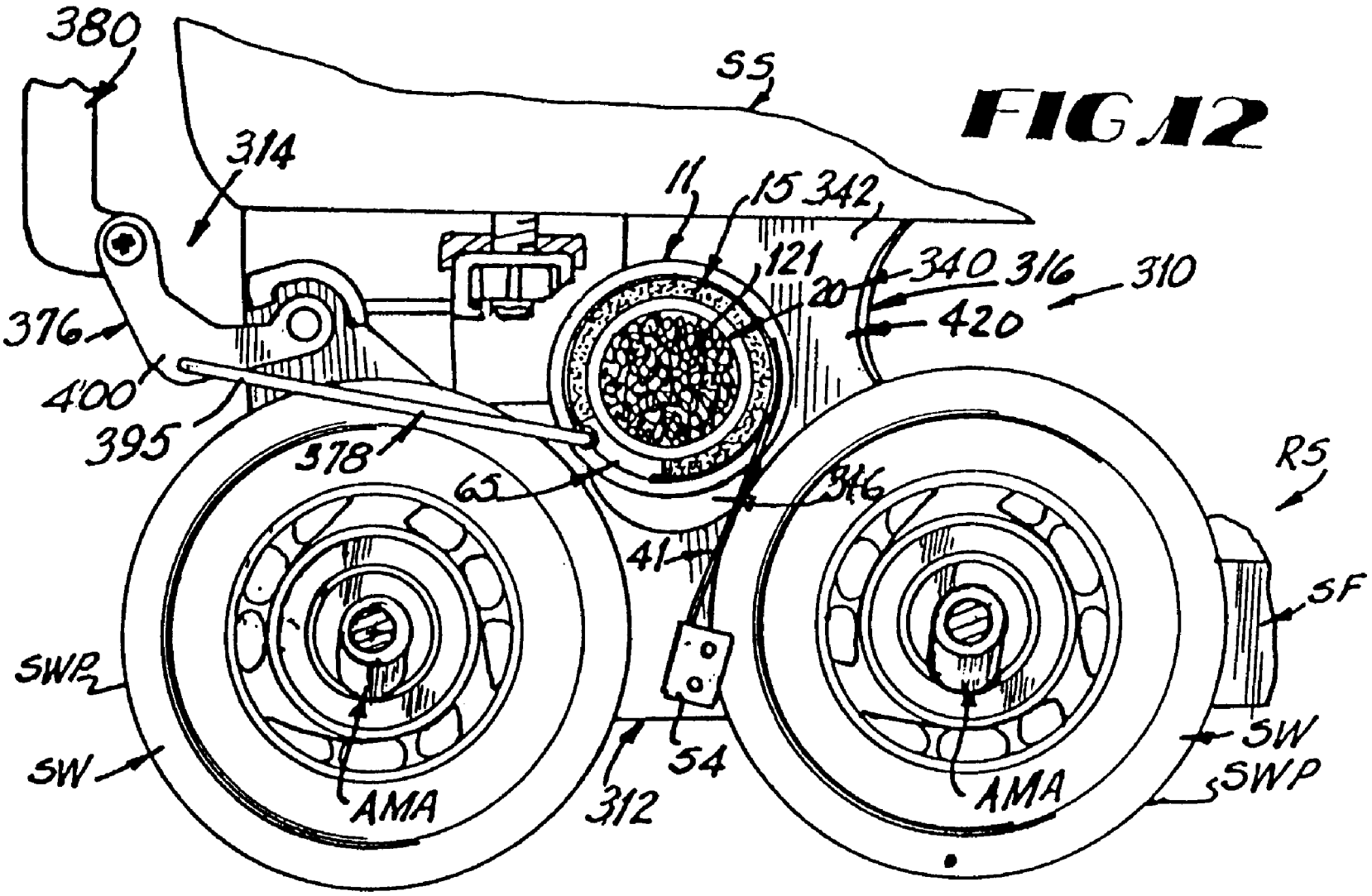
FIG. 12 is a view similar to FIG. 3 of an in-line roller skate embodying an alternative version of the invention.

FIG. 12 illustrates an alternate version, designated by the reference number 310, of the first embodiment of the invention applied to the rearmost set of skate wheels SW of the inline roller skate RS. The mechanism 310 includes the same engaging assembly 11 as the mechanism 10, a modified mounting means 312, a modified actuation means 314, and the same braking means 15. The leaf mounting assembly 41 and the lateral alignment arrangement 65 are the same as with mechanism 10.

The modified mounting means 312 is similar to the means 12 but the side plates 342 of the mounting frame 340 have been reshaped to conform to the shape of the skate side frames SF at the new location. The mounting means 312 serves to locate the engaging assembly 11 above and between the rearmost skate wheel SW and the adjacent skate wheel SW forwardly of the rearmost wheel. The mounting plates 342 serve the same function as the plates 42 and have eccentric openings similar to the openings 44 in the mounting means 12 to fit over the offset bushings mounting the skate wheel axles along with air circulation openings corresponding to the openings 46 in the plates 42 to allow air to flow through the passage 24 in the engaging assembly 11 similarly to that of the mechanism 10.

The connector 54 mounts the leaf members 50 of the leaf mounting assembly 41 so as to locate the engaging assembly 11 as with the first version except that the assembly 11 is located between the rearmost skate wheel SW and the next forward skate wheel. The connector 54 is connected between the plates 342 so that it extends between the skate wheels SW below the level of the skate wheel axes $A_{SW}$. This properly locates the engaging assembly 11 so that it is pressed down against the skate wheels SW with substantially equal forces when the brake is applied.

The actuation means 314 illustrated includes force multiplying pivot assembly 376 mounted between the side frames SF of the skate RS at the rear ends thereof so as to be accessible from the rear of the skate RS and connected to the connector loops 62 on the projecting ends on the brake pad holders 60 through dual rod linkage 378. The force multiplying pivot assembly 376 is connected to the lower rear portion of the pivotal cuff SC by a drive linkage 380. The rod linkage 378 corresponds to the linkage 78 in function and includes two drive rods 395 whose shape and size is selected to cause the braking means 15 to be applied as the cuff SC is pivoted in a counterclockwise direction to pivot the linkage 378 counterclockwise as seen in FIG. 12. This in turn causes the braking forces to be applied to the skate wheels SW similarly to that of the mechanism 10.

The force multiplying pivot assembly 376 is similar to the assembly 76 and has a pair of bellcrank members 400 connecting the drive linkage 380 and the drive rods 395 so that movement of the cuff SC that moves the linkage 380 downwardly will apply the braking means 15 and the opposite movement of the cuff SC will release the braking means 15. To adjust the movement before engagement of the braking means 15, the drive linkage 380 can be made adjustable (not shown).

A flow directing means 420 is also provided for directing the air through the passage 24 in the engaging assembly 11 to cool it. The flow directing means 420 is similar in construction to the flow directing means 120 except the inlet and outlet duct arrangements are modified to conform to the relocation of the mechanism 310 to the rear pair of skate wheels.

This alternate version of the first embodiment of the invention operates similarly to that of the first version. The porous media 121 serves to enhance the heat transfer characteristics of the temperature control means 316. The particular porous media 121 is selected based on the same criteria as the first version.

Second Embodiment

A second embodiment of the invention is illustrated in FIG. 13 being applied to a disc brake mechanism DBM. The brake disc assembly BDA has been modified to incorporate the temperature control means 510 between the spaced apart rotors DR of the assembly. The brake pads BP and the pad forcing mechanism PFM are conventional in operation.

Vanes 511 extend generally radially of the rotational axis $A_{DC}$ to divide the space between the rotors DR into passages 512. A portion of each of the passages 512 is filled with the porous media 521 so that air flowing through the passages 512 will pass through the porous media. The outermost disc $DR_O$ is provided with a central cutout DRC to provide an opening to the inboard end of the passages 512 around the spindle housing SH of the brake mechanism DBM. The vanes 511 are also shaped to provide a centrifugal pumping effect as the rotors DR rotate in the direction shown by the rotation arrow RA. This serves to force additional air through the passages 512 and the porous media 521. The porous media 521 serves the same purpose as the media 121 in the skate embodiment 10. The thickness of the media 521 normal to the rotor surface and the length of the media parallel to the general air flow through the passage 512 is selected in accordance with the parameters set forth above. This insures maximum heat transfer from the rotors DR to the air flowing therethrough.

Third Embodiment

FIG. 14 illustrates a third embodiment, designated 610, of the invention applied to a conventional brake drum BD which has internal brake shoes (not shown) within the brake drum to apply braking forces to the brake drum BD. The brake drum BD is fixedly mounted on a rotating shaft SFT which is to be braked.

The temperature control means 610 includes an annular porous media 611 attached to the periphery of the brake drum BD. The porous media 611 is selected based on the criteria enumerated above so that it has the desired thickness normal to the surface of the brake drum BD and the desired length parallel to the rotational axis $A_{BD}$ of the brake drum.

To force air through the porous media 611, a duct system 612 is provided. The duct system 612 is designed to force air through the porous media 611 in a direction generally parallel to the rotational axis $A_{BD}$ of the brake drum. The duct system 612 includes an annular header duct 614 that is connected to a source of air under pressure (not shown) through an inlet duct 615. The header duct 614 has an annular discharge opening 616 that is sized and located so as to be in registration with the front side of the porous media 611. Thus, air from the pressurized source is directed into the porous media 611 as it rotates adjacent the opening 616.

To force the air from the duct 614 to travel through the porous media 611, an annular shroud 618 is provided around the outer peripheral edge of the porous media 611. The shroud 618 may be stationary or rotate with the brake drum and porous media. The edges of the header duct 614 and the shroud 618 that face each other may be provided with annular sealing lips 619 and 620 respectively to assist in sealing the interface between the duct 614 and shroud 618 if they rotate with respect to each other. This serves to maximize the amount of heat transferred from the brake drum BD to the air passing through the porous media 611.

What is claimed as invention is:

1. A mechanism for engaging a pair of spaced apart rotating members through the peripheries thereof, the rotating members rotating about generally parallel rotational axes spaced apart a prescribed distance, the mechanism adapted to be cooled by a heat transfer fluid and comprising:

an engaging assembly defining a central axis therethrough and a peripheral rotating member engaging surface therearound having a diameter greater than the minimum distance between the peripheries of said rotating members, said rotating member engaging surface adapted to frictionally engage the peripheries of said rotating members so that said member engaging assembly is rotated by said rotating members, said engaging assembly further including a thermally conductive brake member defining a brake pad engaging surface thereon;

mounting means mounting said engaging assembly adjacent the peripheries of said rotating members so that said engaging assembly is free to move a limited distance toward and away from both of said rotating members while rotating about said central axis with said central axis being maintained generally parallel to said rotational axes of said rotating members and with said rotating engaging surface being maintained in contact with said peripheral surfaces;

actuation means for selectively forcing said engaging assembly toward said pair of rotating members so that the contact forces between said engaging assembly and said rotating members are substantially equalized; and braking means for applying a braking force to said brake pad engaging means of said rotating member engaging assembly so that said engaging assembly retards the rotation of said rotating members when said actuation means forces said engaging assembly against said rotating members;

a porous media operatively associated with said brake member for the flow of the heat transfer fluid therethrough to cool said brake member;

flow directing means for directing the heat transfer fluid through said porous media to transfer heat from said brake member to the heat transfer fluid as braking forces are applied to said brake member and said porous media is a heat conductive foam maintained in contact with said brake member.

2. A mechanism for engaging a pair of spaced apart rotating members through the peripheries thereof, the rotating members rotating about generally parallel rotational axes spaced apart a prescribed distance, the mechanism for use as a brake on an in-line roller skate used on a skating surface where the rotating members are a pair of skate wheels, the roller skate including a pair of side frames rotatably mounting the skate wheels therebetween about spaced apart parallel skate wheel axes of rotation so that the skate wheels are generally aligned along a common path, the mechanism adapted to be air cooled and comprising:

an engaging assembly defining a central axis therethrough and a peripheral rotating member engaging surface therearound having a diameter greater than the minimum distance between the peripheries of said rotating members, said rotating member engaging surface adapted to frictionally engage the peripheries of said rotating members so that said member engaging assembly is rotated by said rotating members;

mounting means mounting said engaging assembly adjacent the peripheries of said rotating members so that said engaging assembly is force to move a limited distance toward and away from both of said rotating members while rotating about said central axis with said central axis being maintained generally parallel to said rotational axes of said rotating members and with said rotating engaging surface being maintained in contact with said peripheral surfaces;

actuation means for selectively forcing said engaging assembly toward said pair of rotating members so that the contact forces between said engaging assembly and said rotating members are substantially equalized;

braking means for applying a braking force to said rotating member engaging assembly so that said engaging assembly retards the rotation of said rotating members when said actuation means forces said engaging assembly against said rotating members; and temperature control means for causing a flow of ambient air to be placed in thermal contact with said engaging assembly to cool said engaging assembly during braking so as to prevent heat deterioration of said engaging assembly and the skate wheels, wherein said mounting means mounts said engaging assembly between the side frames above the skate wheels so that said engaging assembly can move toward and away from the peripheries of the skate wheels while rotating about said engaging assembly central axis with said engaging assembly central axis maintained generally parallel to the skate wheel axes of rotation, wherein said engaging assembly includes a thermally conductive brake drum defining at least one brake pad engaging surface thereon for frictional engagement with said braking means, and wherein said temperature control means includes a porous media in contact with said brake drum for the flow of air therethrough to cool said brake drum, and flow directing means for directing a flow of air through said porous media as the skate moves forwardly over the skating surface to cool said brake drum as braking forces are applied thereto.

3. The mechanism of claim 2, wherein said porous media is heat conductive to assist in heat transfer to the air.

4. The mechanism of claim 3, wherein said porous media is in thermal contact with said brake drum.

5. The mechanism of claim 3, wherein said porous media is an aluminum foam.

6. The mechanism of claim 2, wherein said flow directing means includes:

inlet duct means defining an air induction passage therein having a forwardly facing inlet opening thereto and a discharge opening therefrom in registration with said porous media so that a pressure gradient will be generated as the roller skate moves forwardly over the skating surface to force air through the porous media.

7. A mechanism for engaging a pair of spaced apart rotating members through the peripheries thereof, the rotating members rotating about generally parallel rotational axes spaced apart a prescribed distance, the mechanism for use as a brake on an in-line roller skate used on a skating surface where the rotating members are a pair of skate wheels, the roller skate including a pair of side frames rotatably mounting the skate wheels therebetween about spaced apart parallel skate wheel axes of rotation so that the skate wheels are generally aligned along a common path, the mechanism comprising:

an engaging assembly defining a central axis therethrough and a peripheral rotating member engaging surface therearound having a diameter greater than the minimum distance between the peripheries of said rotating members, said rotating member engaging surface adapted to frictionally engage the peripheries of said rotating members so that said member engaging assembly is rotated by said rotating members;

mounting means mounting said engaging assembly adjacent the peripheries of said rotating members so that said engaging assembly is free to move a limited distance toward and away from both of said rotating members while rotating about said central axis with said central axis being maintained generally parallel to said rotational axes of said rotating members and with said rotating engaging surface being maintained in contact with said peripheral surfaces;

actuation means for selectively forcing said engaging assembly toward said pair of rotating members so that the contact forces between said engaging assembly and said rotating members are substantially equalized;

braking means for applying a braking force to said rotating member engaging assembly so that said engaging assembly retards the rotation of said rotating members when said actuation means forces said engaging assembly against said rotating members, wherein said mounting means mounts said engaging assembly between the side frames above the skate wheels so that the engaging assembly can move toward and away from the peripheries of the skate wheels while rotating about the engaging assembly central axis with said engaging assembly central axis maintained generally parallel to the skate wheel axes of rotation, wherein said engaging assembly defines at least one cylindrical brake pad engaging surface thereon concentrically about the central axis of said engaging assembly, wherein said braking means further comprises:

arcuate brake pad means for frictionally engaging said cylindrical brake pad engaging surface on said engaging assembly; and flexible pad holder means mounting said brake pad means thereon, said pad holder means operatively connected to said mounting means and said actuation means, and, wherein said actuation means and said mounting means are constructed and arranged to selectively cause said brake pad means to frictionally engage said engaging assembly while simultaneously forcing said engaging assembly against the peripheries of said skate wheels to brake same.

8. A mechanism for engaging a pair of spaced apart rotating members through the peripheries thereof, the rotating members rotating about generally parallel rotational axes spaced apart a prescribed distance, the mechanism for use as a brake on an in-line roller skate used on a skating surface where the rotating members are a pair of skate wheels, the roller skate including a pair of side frames rotatably mounting the skate wheels therebetween about spaced apart parallel skate wheel axes of rotation so that the skate wheels are generally aligned along a common path, the mechanism comprising:

an engaging assembly defining a central axis therethrough and a peripheral rotating member engaging surface therearound having a diameter greater than the minimum distance between the peripheries of said rotating members, said rotating member engaging surface adapted to frictionally engage the peripheries of said rotating members so that said member engaging assembly is rotated by said rotating members;

mounting means mounting said engaging assembly adjacent the peripheries of said rotating members so that said engaging assembly is free to move a limited distance toward and away from both of said rotating members while rotating about said central axis with said central axis being maintained generally parallel to said rotational axes of said rotating members and with said rotating engaging surface being maintained in contact with said peripheral surfaces;

actuation means for selectively forcing said engaging assembly toward said pair of rotating members so that the contact forces between said engaging assembly and said rotating members are substantially equalized; and braking means for applying a braking force to said rotating member engaging assembly so that said engaging assembly retards the rotation of said rotating members when said actuation means forces said engaging assembly against said rotating members, wherein said mounting means mounts said engaging assembly between the side frames above the skate wheels so that the engaging assembly can move toward and away from the peripheries of the skate wheels while rotating about the engaging assembly central axis with said engaging assembly central axis maintained generally parallel to the skate wheel axes of rotation, and wherein said engaging assembly includes:

a thermally conductive cylindrical brake drum defining a cylindrical brake pad engaging surface thereon for frictional engagement with said braking means; and annular transfer roller means mounted around said brake drum and defining said peripheral rotating member engaging surface thereon for frictionally engaging the skate wheels, said peripheral engaging surface having a diameter larger than the diameter of said brake drum, and insulating means for thermally insulating said engaging surface on said transfer roller from said brake drum so that the heat generated by the frictional interface between said brake pad engaging surface and said braking means tends not to be transferred to the skate wheels.

9. A mechanism for engaging a pair of spaced apart rotating members through the peripheries thereof, the rotating members rotating about generally parallel rotational axes spaced apart a prescribed distance, the mechanism for use as a brake on an in-line roller skate used on a skating surface where the rotating members are a pair of skate wheels, the roller skate including a pair of side frames rotatably mounting the skate wheels therebetween about spaced apart parallel skate wheel axes of rotation so that the skate wheels are generally aligned along a common path, the mechanism comprising:

an engaging assembly defining a central axis therethrough and a peripheral rotating member engaging surface therearound having a diameter greater than the minimum distance between the peripheries of said rotating members, said rotating member engaging surface adapted to frictionally engage the peripheries of said rotating members so that said member engaging assembly is rotated by said rotating members;

mounting means mounting said engaging assembly adjacent the peripheries of said rotating members so that said engaging assembly is free to move a limited distance toward and away from both of said rotating members while rotating about said central axis with said central axis being maintained generally parallel to said rotational axes of said rotating members and with said rotating engaging surface being maintained in contact with said peripheral surfaces;

actuation means for selectively forcing said engaging assembly toward said pair of rotating members so that the contact forces between said engaging assembly and said rotating members are substantially equalized; and braking means for applying a braking force to said rotating member engaging assembly so that said engaging assembly retards the rotation of said rotating members when said actuation means forces said engaging assembly against said rotating members, wherein said mounting means mounts said engaging assembly between the side frames above the skate wheels so that the engaging assembly can move toward and away from the peripheries of the skate wheels while rotating about the engaging assembly central axis with said engaging assembly central axis maintained generally parallel to the skate wheel axes of rotation, wherein said mounting means further includes at least one elongate leaf member flexible in a first direction and substantially inflexible in a second direction normal to said first direction, said leaf member mounted so that said second direction is oriented substantially parallel to the axes of rotation of the skate wheels, and said engaging assembly rotatably mounted to said leaf member so that said leaf member can flex to allow said engaging assembly to move toward and away from the peripheries of the skate wheels but said engaging assembly is held in place laterally of the skate wheels by said leaf member, wherein said engagement assembly defines a pair of opposed side bearing surfaces thereon located concentrically of said central axis of said engaging assembly and oriented normal to said central axis, and wherein said mounting means further defines a pair of opposed side locating surfaces thereon adapted to cooperate with said side bearing surfaces on said engaging assembly to laterally locate said engaging assembly.

10. A mechanism for engaging a pair of spaced apart rotating members through the peripheries thereof, the rotating members rotating about generally parallel rotational axes spaced apart a prescribed distance comprising, the mechanism for use as a brake on an in-line roller skate used on a skating surface where the rotating members are a pair of skate wheels, the roller skate including a pair of side frames rotatably mounting the skate wheels therebetween about spaced apart parallel skate wheel axes of rotation so that the skate wheels are generally aligned along common path, the mechanism for use with an in-line skate equipped with a pivotal cuff that the skater can move by pivoting his leg with respect to his foot, the mechanism comprising:

an engaging assembly defining a central axis therethrough and a peripheral rotating member engaging surface therearound having a diameter greater than the minimum distance between the peripheries of said rotating members, said rotating member engaging surface adapted to frictionally engage the peripheries of said rotating members so that said member engaging assembly is rotated by said rotating members;

mounting means mounting said engaging assembly adjacent the peripheries of said rotating members so that said engaging assembly is free to move a limited distance toward and away from both of said rotating members while rotating about said central axis with said central axis being maintained generally parallel to said rotational axes of said rotating members and with said rotating engaging surface being maintained in contact with said peripheral surfaces;

actuation means for selectively forcing said engaging assembly toward said pair of rotating members so that the contact forces between said engaging assembly and said rotating members are substantially equalized; and braking means for applying a braking force to said rotating member engaging assembly so that said engaging assembly retards the rotation of said rotating members when said actuation means forces said engaging assembly against said rotating members, wherein said mounting means mounts said engaging assembly between the side frames above the skate wheels so that the engaging assembly can move toward and away from the peripheries of the skate wheels while rotating about the engaging assembly central axis with said engaging assembly central axis maintained generally parallel to the skate wheel axes of rotation, wherein said actuation means is operatively connected to the cuff so that a prescribed movement of the cuff causes said actuation means to apply a braking force to said engaging assembly and the skate wheels.

11. The mechanism of claim 2, wherein the length and thickness or radius of said porous media is selected to achieve at least about 90% of the brake drum cooling rate attainable for said brake drum using porous media.

12. The mechanism of claim 2, wherein the length and thickness or radius of said porous media is selected so that the air passing through said porous media is heated up to a prescribed percentage of the surface temperature of said porous media when the air exits said porous media.

13. The mechanism of claim 2, wherein the porosity and density of said porous media is selected to achieve at least about 90% of the maximum brake drum cooling rate attainable for said brake drum using porous media.

14. The mechanism of claim 2, wherein said porous media is aluminum foam.

15. The mechanism of claim 14, wherein the length of said porous media is about 0.75–2.5 inches, the thickness or radius of said porous media is about 0.3–0.75 inch, said porous media has about 8–50 pores per inch, and the porous media has a thermal conductivity of at least 5 W/m-deg C.

16. A mechanism for engaging a pair of spaced apart rotating members through the peripheries thereof, the rotating members rotating about generally parallel rotational axes spaced apart a prescribed distance comprising, the mechanism for use as a brake on an in-line roller skate used on a skating surface where the rotating members are a pair of skate wheels, the roller skate including a pair of side frames rotatably mounting the skate wheels therebetween about spaced apart parallel skate wheel axes of rotation so that the skate wheels are generally aligned along common path, the mechanism comprising:

an engaging assembly defining a central axis therethrough and a peripheral rotating member engaging surface therearound having a diameter greater than the minimum distance between the peripheries of said rotating members, said rotating member engaging surface adapted to frictionally engage the peripheries of said rotating members so that said member engaging assembly is rotated by said rotating members;

mounting means mounting said engaging assembly adjacent the peripheries of said rotating members so that said engaging assembly is free to move a limited distance toward and away from both of said rotating members while rotating about said central axis with said central axis being maintained generally parallel to said rotational axes of said rotating members and with said rotating engaging surface being maintained in contact with said peripheral surfaces;

actuation means for selectively forcing said engaging assembly toward said pair of rotating members so that the contact forces between said engaging assembly and said rotating members are substantially equalized;

braking means for applying a braking force to said rotating member engaging assembly so that said engaging assembly retards the rotation of said rotating members when said actuation means forces said engaging assembly against said rotating members;

wherein said mounting means mounts said engaging assembly between the side frames above the skate wheels so that the engaging assembly can move toward and away from the peripheries of the skate wheels while rotating about the engaging assembly central axis with said engaging assembly central axis maintained generally parallel to the skate wheel axes of rotation, wherein said mounting means further includes at least one elongate leaf member flexible in a first direction and substantially inflexible in a second direction normal to said first direction, said leaf member mounted so that said second direction is oriented substantially parallel to the axes of rotation of the skate wheels, and said engaging assembly rotatably mounted to said leaf member so that said leaf member can flex to allow said engaging assembly to move toward and away from the peripheries of the skate wheels but said engaging assembly is held in place laterally of the skate wheels by said leaf member, wherein said engaging assembly includes:

a thermally conductive cylindrical brake drum defining a cylindrical brake pad engaging surface thereon for frictional engagement with said braking means; and annular transfer roller means mounted around said brake drum and defining said peripheral rotating member engaging surface thereon for frictionally engaging the skate wheels, said peripheral engaging surface having a diameter larger than the diameter of said brake drum, and insulating means for thermally insulating said engaging surface on said transfer roller from said brake drum so that the heat generated by the frictional interface between said brake pad engaging surface and said braking means tends not to be transferred to the skate wheels.

17. The mechanism of claim 16, wherein said brake drum defines a cooling passage therethrough along the drum central axis and further including temperature control means comprising:

a heat conductive porous media in said cooling passage and in connect with said brake drum for the flow of air therethrough to cool said brake drum; and flow directing means for directing a flow of air through said porous media as the skate moves forwardly over the skating surface to cool said brake drum as braking forces are applied thereto.

18. The mechanism of claim 17, wherein said braking means further comprises:

arcuate brake pad means for frictionally engaging said cylindrical brake pad engaging surface on said brake drum, and flexible pad holder means mounting said brake pad means thereon, said pad holder means operatively connected to said mounting means and said actuation means; and wherein said actuation means and said mounting means are constructed and arranged to cause said brake pad means to frictionally engage said brake drum while simultaneously forcing said transfer roller against the peripheries of said skate wheels to brake same.

19. The mechanism of claim 18, wherein said brake drum defines two of said cylindrical brake pad engaging surfaces thereon positioned on opposite sides of said transfer roller;

wherein said braking means includes two of said arcuate brake pad means, one being associated with each of said brake pad engaging surfaces; and two of said flexible pad holder means, each of said pad holder means mounting one of said pad means; and, wherein said mounting means includes two of said leaf members, each of said leaf members mounting one of said pad holder means thereon so that one of said brake pads is in registration with each of said brake pad engaging surfaces on said brake drum whereby braking forces are applied to said brake drum through both of said brake pad engaging surfaces.

20. The mechanism of claim 19, wherein said transfer roller defines a pair of opposed side bearing surfaces thereon located concentrically of said central axis of said brake drum and oriented normal to said central axis; and wherein said pad holder means further defines a pair of opposed side locating surfaces thereon adapted to cooperate with said side bearing surfaces on said transfer roller to laterally locate said engaging assembly.

21. The mechanism of claim 20 for use with an in-line skate equipped with a pivotal cuff that the skater can move by pivoting his leg with respect to his foot, wherein said actuation means is operatively connected to the cuff so that a prescribed movement of the cuff causes said actuation means to apply a braking force to said engaging assembly and the skate wheels.

22. The mechanism of claim 21 wherein said actuation means includes force multiplication means for increasing the force exerted by said cuff on said braking means and on said engaging assembly against the skate wheels.

23. The mechanism of claim 21 wherein said actuation means further includes motion multiplying means for multiplying the amount of movement of the cuff.

* * * * *